US009051705B1

(12) United States Patent
Rose

(10) Patent No.: US 9,051,705 B1
(45) Date of Patent: Jun. 9, 2015

(54) GROUND ROD DRIVING TOOL

(71) Applicant: Rick Rose, Dry Ridge, KY (US)

(72) Inventor: Rick Rose, Dry Ridge, KY (US)

( * ) Notice: Subject to any disclaimer, the term of this patent is extended or adjusted under 35 U.S.C. 154(b) by 0 days.

(21) Appl. No.: 14/453,748

(22) Filed: Aug. 7, 2014

(51) Int. Cl.

| | |
|---|---|
| ***E02D 1/04*** | (2006.01) |
| ***B25D 1/00*** | (2006.01) |
| ***B25D 1/16*** | (2006.01) |
| ***E02D 7/04*** | (2006.01) |

(52) U.S. Cl.
CPC ... *E02D 7/04* (2013.01); *B25D 1/16* (2013.01)

(58) Field of Classification Search
CPC ..... B25D 1/00; B25D 1/16; B25D 1/04
USPC ..... 227/147; 173/90, 91
See application file for complete search history.

(56) References Cited

U.S. PATENT DOCUMENTS

| | | | | |
|---|---|---|---|---|
| 224,578 | A | | 2/1880 | Carpenter |
| 3,036,482 | A | | 9/1960 | Kenworthy et al. |
| 3,783,956 | A | | 1/1974 | Schultz |
| 4,315,551 | A | | 2/1982 | Iannone |
| 5,181,644 | A | * | 1/1993 | Ferrell ..... 227/147 |
| 5,248,002 | A | | 9/1993 | Williams |
| 5,337,836 | A | | 8/1994 | Williams |
| 6,205,602 | B1 | | 3/2001 | Dettweiler |
| 2008/0257113 | A1 | | 10/2008 | Neumarkel |

* cited by examiner

*Primary Examiner* — Michelle Lopez
(74) *Attorney, Agent, or Firm* — Steve Witters; Witters & Associates

(57) ABSTRACT

A ground rod driving tool and method of use is presently disclosed. The ground tool comprises a longitudinally extending first component part having a sleeve extending from a first longitudinal end configured to receive a portion of a ground rod, a ground rod stop, and a male coupler extending from a second longitudinal end. A longitudinally extending second component part has a female coupler in a first longitudinal end thereof configured to closely receive an end portion of a ground rod. The first component part and the second component part are configured to couple and uncouple with each other, with the male and female couplers, and have their longitudinal axes aligned upon coupling. A method of driving a ground rod into the ground is also provided herein.

20 Claims, 7 Drawing Sheets

GROUND ROD DRIVING TOOL

FIELD OF THE DISCLOSURE

This disclosure relates generally to ground rod driving tools, and more specifically tools configured to drive a ground rod a desired depth into the ground.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ground rods are designed to carry current away from an electrical surge and route it safely into the ground. For example, ground rods are often a component part of a lightning protection system for protecting a structure in event of a lighting strike. A typical lighting protection system comprises a ground rod, wire, and a lightning rod or other feature configured and disposed with the structure for conduction of electricity from lightening and grounding to earth. For example, if lightning strikes the structure, it will preferentially be conducted to ground, through the wire, instead of passing through the structure where it could start a fire or cause electrocution.

A ground rod is an electrode installed in the ground to provide a low resistance electrical path to ground or earth. Grounding rods are often required by law, and where they are not required by law, they are in common use because they are excellent safety devices which are affordable to install. A grounding rod typically consists of a long rod made of conductive material, such as copper or copper alloy, which is driven into the ground. A length of eight feet is typically standard, with the rod being substantially fully driven into the ground wherein it minimizes a tripping hazard. Once the ground is driven into the ground, it can be connected to a lightning rod, or other electrical system, with the use of a ground connector and a wire.

Ground rods typically must be driven into the ground to provide an electrical grounding to earth. Often, problems are associated with driving ground rods into the ground and these problems may be exemplified when the ground is hard.

SUMMARY

In at least one aspect of the present disclosure, a ground rod driving tool comprises a longitudinally extending first component part comprising a sleeve configured to closely receive a portion of a ground rod, a ground rod stop, and a male coupler axially extending from an axial end of the sleeve. A longitudinally extending second component part has a female coupler in a first longitudinal end thereof configured to closely receive an end portion of a ground rod. The first component part and the second component part are configured to removably couple with each other, with the male and female couplers, and have their longitudinal axes aligned upon coupling. The coupled first and second component parts having a mass sufficient to drive a ground rod into the ground by sliding the sleeve about the ground rod and impinging the ground rod stop. The second component part is configured to transfer a driving force from a hammer impinging a second longitudinal end thereof, to a ground rod and drive the ground rod into the ground.

In another aspect of the present disclosure, a ground rod driving tool comprises a longitudinally extending sleeve configured to closely receive an end portion of a ground rod, a stop proximate an end of the longitudinally extending sleeve, a male coupler longitudinally extending from the end of the sleeve proximate the stop, a longitudinally extending ground rod cover having a female coupler, in a longitudinal end thereof, and the longitudinally extending sleeve and the longitudinally extending ground rod cover are removably coupled with their male and female couplers and have their longitudinal axes aligned.

In a further aspect of the present disclosure, a method for driving a ground rod into the ground is disclosed. The method comprises the steps of: axially aligning and coupling a male coupler of a longitudinally extending first component part of a ground rod driving tool with a female coupler of a longitudinally extending second component part of the ground driving tool; positioning a first ground rod end on the ground; receiving a portion of a second end of the ground rod with a sleeve longitudinally extending from the first component part; repeatedly sliding the sleeve portion of the ground rod driving tool up and down about the second end of the ground rod and impinging a ground rod stop, thereby transferring the momentum of the ground rod driving tool to the ground rod and driving the ground rod into the ground until the sleeve becomes proximate the ground; removing the ground rod driving tool from the ground rod; removing the second component part of the ground rod driving tool from the first component part of the ground rod driving tool; closely receiving a portion of the second end of the ground rod with the female coupler of the second component part of the ground rod driving tool; and hammering a longitudinal end of the second component part, opposite the female coupler, of the ground rod driving tool and driving the ground rod into the ground until the second end of the ground rod becomes proximate the ground.

BRIEF DESCRIPTIONS OF THE DRAWINGS

The following figures, which are idealized, are not to scale and are intended to be merely illustrative of aspects of the present disclosure and non-limiting. In the drawings, like elements are depicted by like reference numerals. The drawings are briefly described as follows.

DETAILED DESCRIPTION

The ground rod driving tool of the present disclosure is configured for driving a ground rod substantially completely into the ground or below grade. The ground rod driving tool comprises two component parts which may be separated from one another. The ground rod driving tool is configured to first drive the ground rod into the ground wherein a length, such as more than a foot, of the ground rod extends from the ground. The two components may then be separated and one component part may be placed upon the ground rod extending from the ground. The ground rod may then be driven a desired depth into the ground. It may be desired to drive the ground rod substantially completely into the ground. For example, it may be desired to only leave a sufficient length of the ground rod above grade for connecting a ground wire with a connector. Alternatively, it may be configured to drive the ground rod with or below grade.

Reference will now be made in detail to the present exemplary embodiments and aspects of the present invention, examples of which are illustrated in the accompanying figures.

Figure 1:
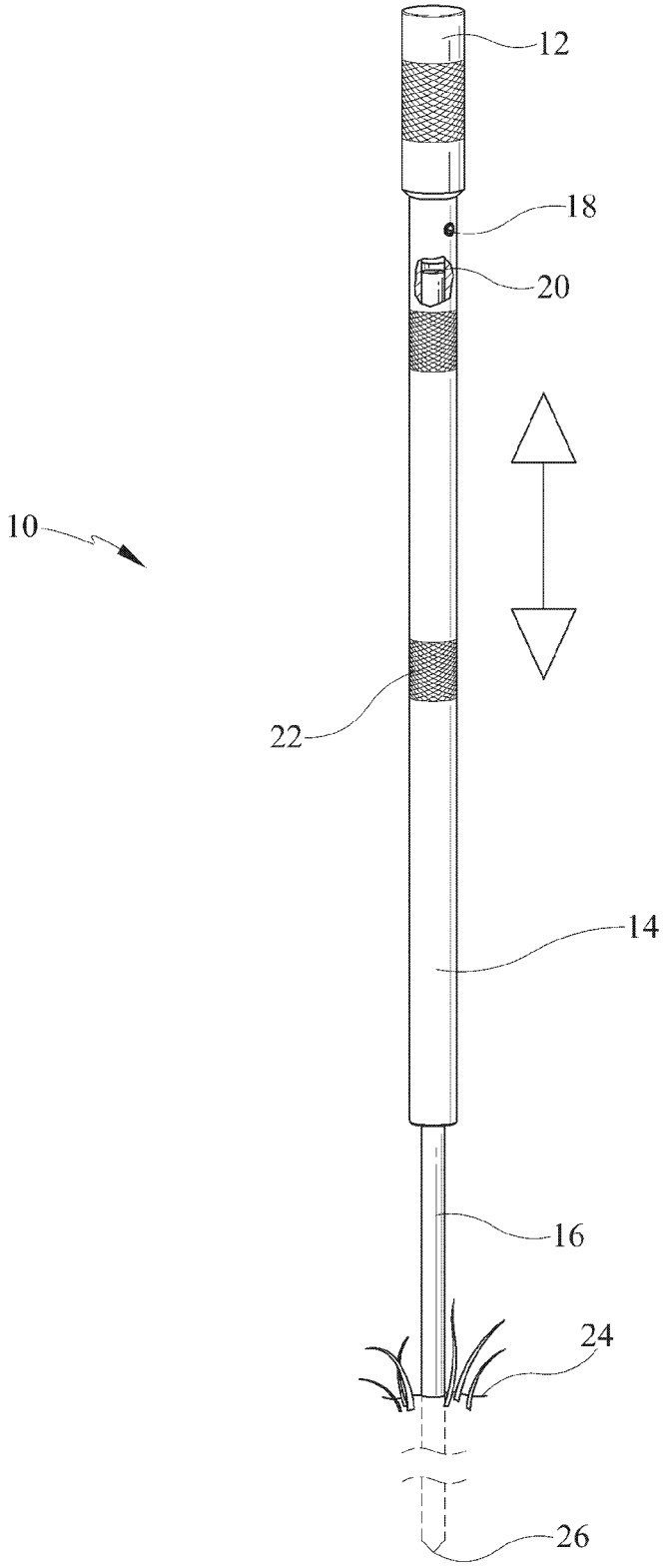
FIG. 1 is a perspective view of a ground rod driving tool of the present disclosure having a cut-away portion and showing function.

FIG. 1 shows ground rod driving tool 10 of the present disclosure driving ground rod 16 into the ground 24. Ground rod driving tool 10 comprises a longitudinally extending first component part 14 comprising a sleeve closely receiving a portion of ground rod 16. Longitudinally extending second component part 12 is removably coupled with a first longitudinal end of longitudinally extending first component part 14. First component part 14 and second component part 12 are coupled with each other and have their longitudinal axes aligned.

Figure 4:
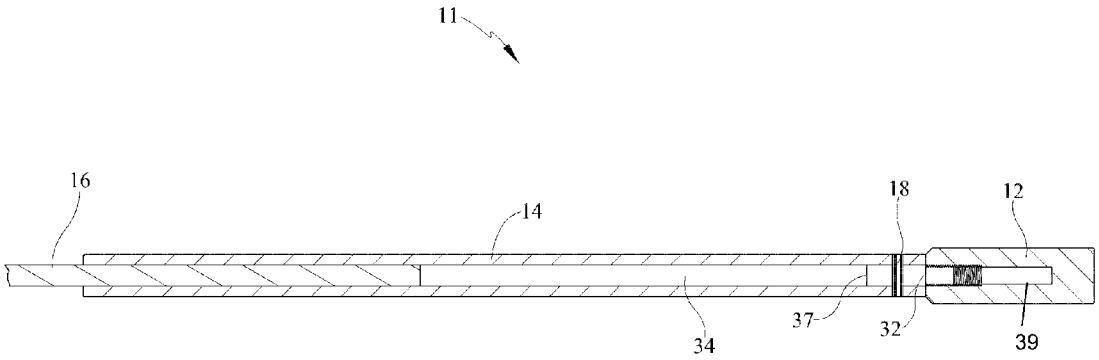
FIG. 4 is a cross-sectional view of the ground rod driving tool of the present disclosure showing cooperation of its component parts.

The mass of the coupled first and second component parts, 12 and 14, is sufficient to drive a ground rod into the ground by sliding the sleeve about the ground rod 16 and impinging a second ground rod end 20 with a ground rod stop 33, shown in FIG. 4. In at least one aspect of the present disclosure, ground rod driving tool 10 has a mass in a range of about 5 pounds to about 25 pounds. For example, ground rod driving tool may have a mass in a range of about 15 pounds to about 18 pounds. As shown in FIG. 1, ground rod driving tool 10 may be moved up and down, as indicated with the double headed arrow, to drive first end 26 of ground rod 16 into ground 24.

Optionally, outer portions of first component part 14 and/or second component part 12 may be knurled or have other features for gripping, 22.

Figure 2:
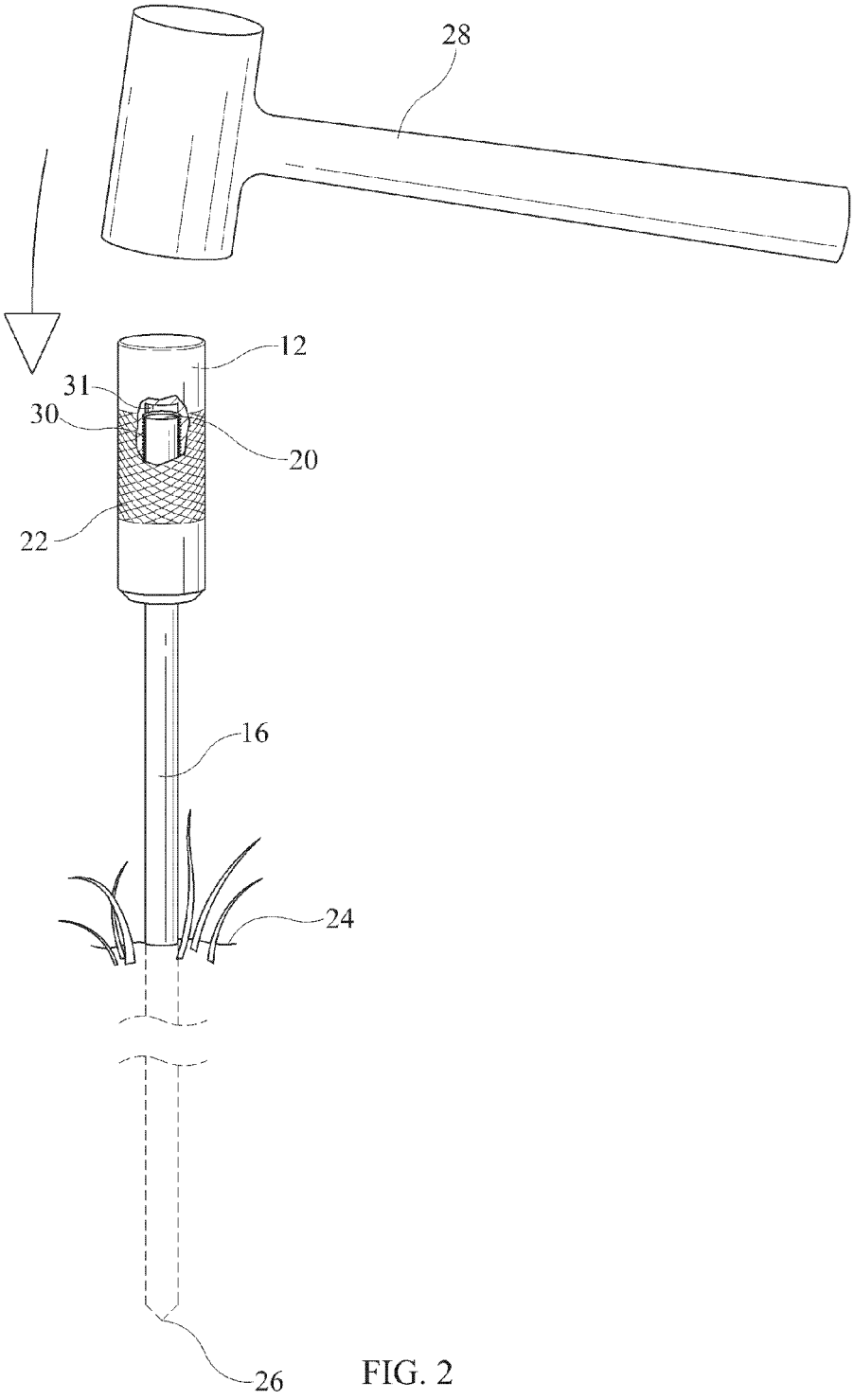
FIG. 2 is a perspective view of a portion of the ground rod driving tool of the present disclosure having a cut-away portion and showing further function.

FIG. 2 is a perspective view of second component part 12 of ground rod driving tool 10 showing its further function. Upon driving ground rod 16 into the ground 24 with ground rod driving tool 10, as shown in FIG. 1, about 2-4 feet of ground rod 16 may remain above grade or surface of ground 24. Second component part or ground rod cover 12 may then be removed from first component part 14 and placed about second ground rod end 20 of ground rod 16, as shown in FIG. 2. Placement of second component part 12 about ground rod 16 provides for the further driving of ground rod 16 into ground 24. For example, a hammer 28 may be used to strike a longitudinal end of second component part 12 until ground rod 16 is at grade, below grade, or has a desired length above grade of ground 24. A portion of second component part 12 may be driven below grade until ground rod 16 is at grade, below grade, or is a desired length above grade of ground 24.

Figure 3:
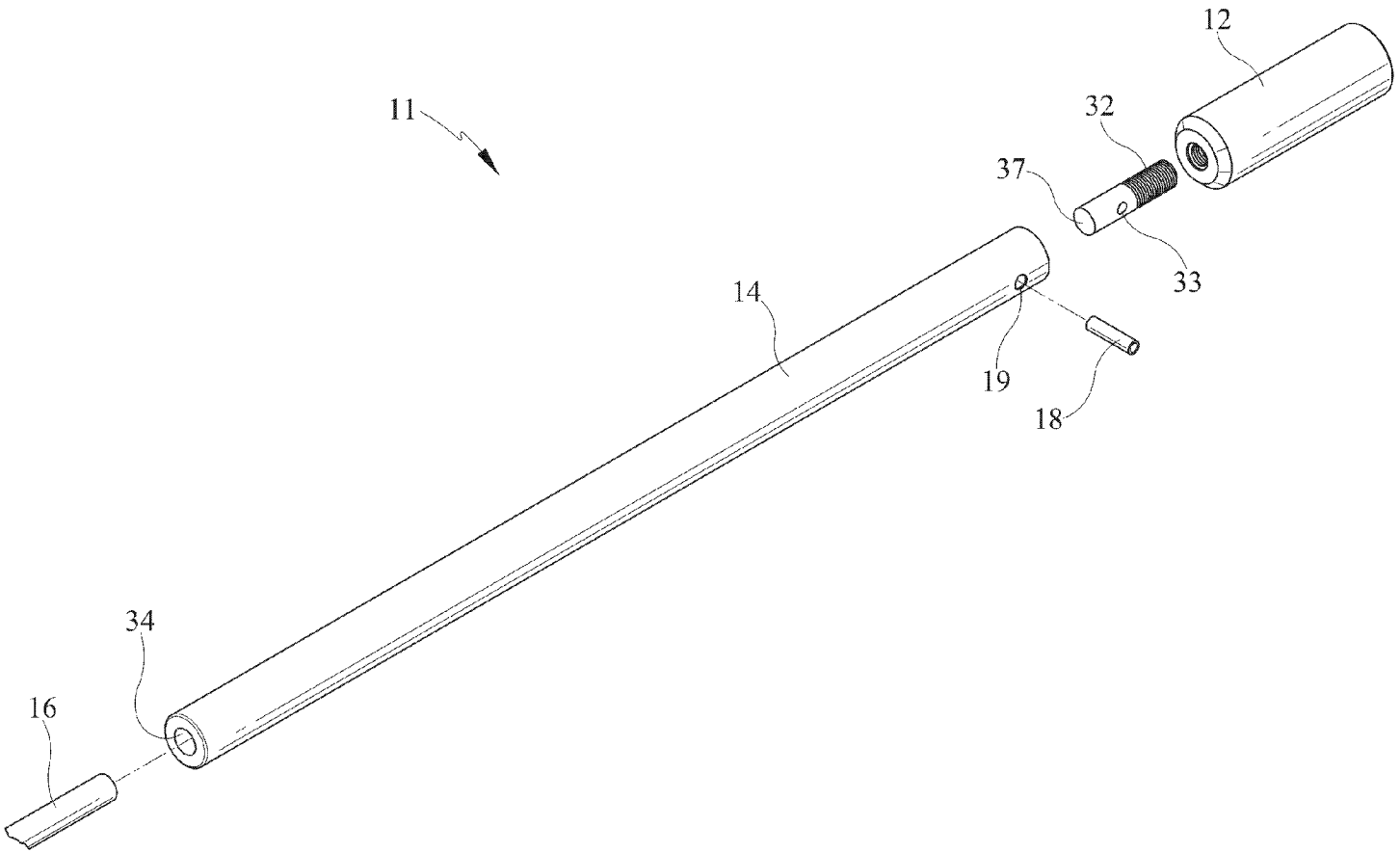
FIG. 3 is a perspective exploded view of the ground rod driving tool of the present disclosure showing its component parts.

FIG. 3 is a perspective exploded view of ground rod driving tool 11 showing its component parts. Ground rod driving tool 11 is void of knurling or other features for gripping. First component part 14 has sleeve portion 34 configured to receive ground rod 16. Second component part 12 is removed from first component part 14 and shows a coupler configured to removably couple first component part 14 with second component part 12. A threaded dowel 32 may be provided with an orifice 33. Threaded dowel 32 may be inserted into a portion of sleeve 34 until orifice 33 aligns with orifice 19 in first component part 14. Upon alignment of the orifices, pin 18 may then be inserted through the orifices and secure threaded dowel 32 in sleeve 34.

FIG. 4 is a cross-sectional view of ground rod driving tool 11 of the present disclosure showing cooperation of its component parts. First component part 14 comprises sleeve 34. Sleeve 34 is shown closely receiving a portion of ground rod 16. Sleeve 34 comprises an end portion 39. End portion 39 has a non-threaded portion of threaded dowel 32 therein. Pin 18 is extending through orifices in threaded dowel 32 and first component part 14, securing a portion of threaded dowel 32 in sleeve 34. Second component part 12 has a bore with a threaded portion 30 and a non-threaded portion 31 extending into a longitudinal end thereof. A portion of threaded dowel 32 is threadingly engaged with threaded portion 30 of second component part 12, thus coupling first component part 14 with second component part 12. An end of threaded dowel 32 provides for stop 37. Stop 37 is configured and disposed to transfer a driving force from ground rod driving tool 11 to ground rod 16.

In at least one aspect of the present disclosure, ground rod driving tool 10 or 11 has a center of gravity within a center third of its length. For example, a ground rod driving tool 11 having a length of 36 inches may have its center of gravity more than 12 inches from each of its longitudinal ends. In at least one aspect, ground rod driving tool 11 has its center of gravity more than 15 inches from each longitudinal end. Having a center of gravity proximate central point, or within a center third, of the ground rod driving tool may ease its use. For example, a user may grip solely its central portion and lift and rotate the ground rod driving tool as desired which may be advantageous in placing sleeve 34 about ground rod 16.

Figure 5:
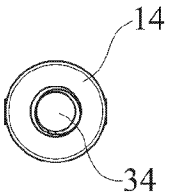
FIG. 5 is an end view of the ground rod driving tool of the present disclosure showing a sleeve.

FIG. 5 shows an end view of first component part 14 of a ground rod driving tool 11 of the present disclosure. As shown in FIG. 5, sleeve 34 has a round inner surface configured to closely receive a ground rod. Ground rods may typically have an outer diameter of about ½ or ⅝ inches. In at least one aspect of the present disclosure, sleeve 34 is round and has a diameter of about ¾ inches. In this aspect, sleeve 34 is configured to closely receive the typical ground rods having an outer diameter of about ½ or ⅝ inches.

Figure 6:
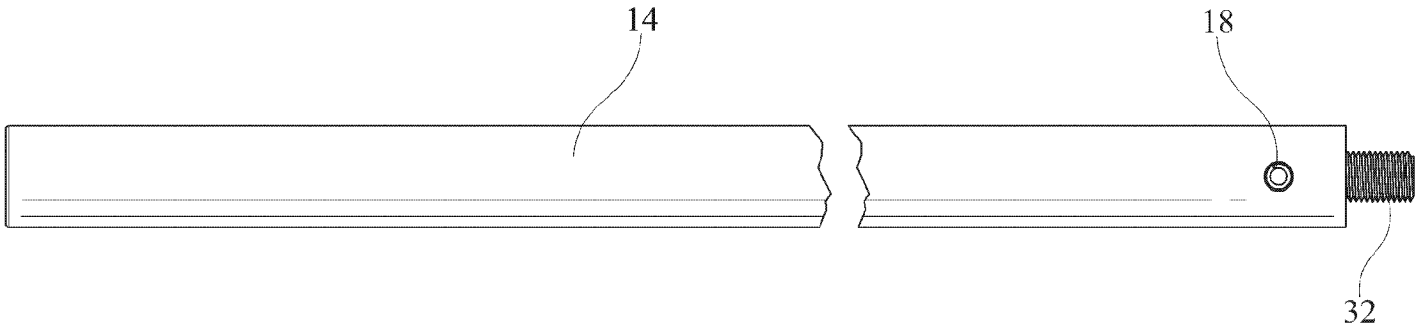
FIG. 6 is a cut-a-way side view of a portion of the ground rod driving tool of the present disclosure.

FIG. 6 is a cut-a-way side view of first component part 14. First component part 14 may have an axial length between about 2 and 4 feet. First component part 14 may comprise cold rolled steel, however other compositions are within the scope of the present disclosure. For example, first component part 14 may comprise hot rolled steel or other materials that provide for strength and mass of the ground rod driving tool sufficient to drive a ground rod into the ground by sliding sleeve 34 about the ground rod and impinging ground rod stop 37, shown in FIG. 4.

Figure 8:
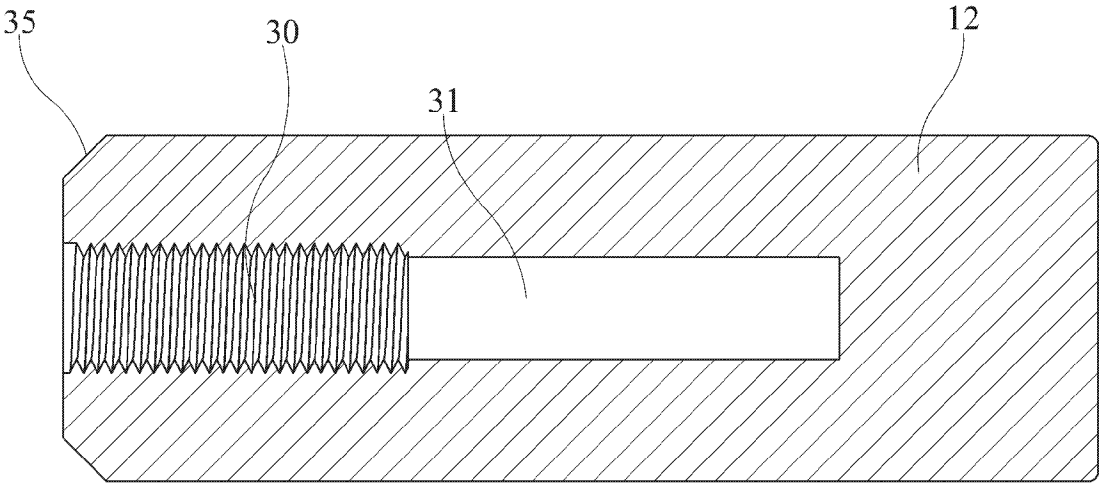
FIG. 8 is a cross-sectional view of the portion of the ground rod driving tool shown in FIG. 7.
Figure 7:
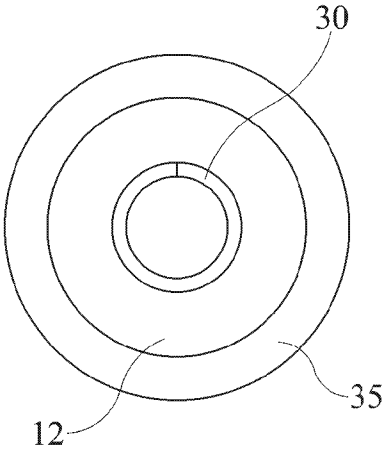
FIG. 7 is an end view of a portion of the ground rod driving tool of the present disclosure.

FIGS. 7 and 8 are end and cross-sectional views of second component part 12 of the ground rod driving tool of the present disclosure. A first longitudinal end of second component part 12 is chamfered with angled portion 35. A female coupler or threaded portion 30 axially extends into the center of the first longitudinal end and is configured to closely receive an end portion of a ground rod and removably couple with a male coupler extending from the first component part. Non-threaded portion 31 axially extends from threaded portion 30 further into the center of the first longitudinal end of second component part 12 and is configured to closely receive an end portion of a ground rod. Threaded portion 30 and non-threaded portion 31 are configured and disposed to closely receive a sufficient length of a ground rod to resist undesired removal of second component part 12 from ground rod 16 upon striking a second longitudinal end of second component part 12, as shown in FIG. 2. In at least one aspect of the present disclosure, the threaded female coupler or threaded portion 30 is configured to contact the ground rod, immediately following hammering a second longitudinal end of second component part 12, and resist separation of second component part 12 from the ground rod.

In at least one aspect of the present disclosure, second component part 12 comprises a malleable material, such as hot rolled steel, and is configured to resist fracture upon being hammered. In this aspect, repeatedly striking second component part 12 may cause the second longitudinal end to deform or "mushroom", instead of fracturing. Since the struck longitudinal end of the second component part 12 is opposite the longitudinal end having the threaded female coupler, or threaded portion 30, the deformation of the struck longitudinal end of second component part 12 may not adversely affect the ground rod driving tool of the present disclosure. For example, a mushroomed longitudinal end of second component part may not interfere with coupling first component part 14 with second component part 12.

Figure 10:
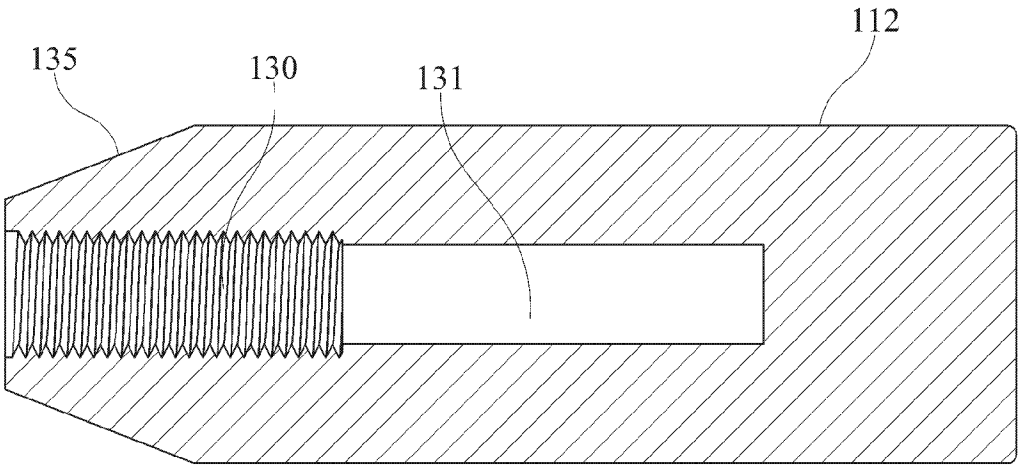
FIG. 10 is a cross-sectional view of the portion of the ground rod driving tool shown in FIG. 9.
Figure 9:
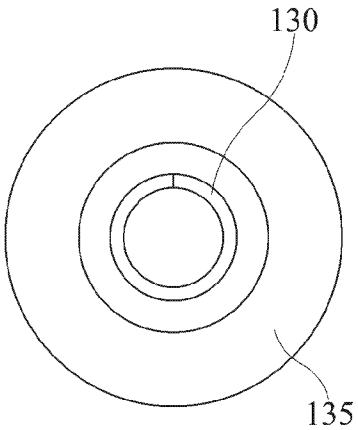
FIG. 9 is an end view of a portion of an alternative embodiment of the ground rod driving tool of the present disclosure.

FIGS. 9 and 10 are end and cross-sectional views of second component part 112 of the ground rod driving tool of the present disclosure. A first longitudinal end of second component part 112 is chamfered with angled portion 135. A female coupler or threaded portion 130 axially extends into the center of the first longitudinal end and is configured to closely receive an end portion of a ground rod and couple, as well as uncouple, with a male coupler extending from the second component part. Non-threaded portion 131 axially extends from threaded portion 130 further into the center of the first longitudinal end of second component part 112 and is configured to closely receive an end portion of a ground rod. Chamfered angled portion 135 is greater than 45°. In this respect, when driving the ground rod further into the ground with second component part 112, as shown in FIG. 2, chamfered angled portion 135 may be advantageous in driving a ground rod completely or almost completely, into the ground, or below grade. For example, chamfered angled portion 135, greater than 45°, may decrease the resistance on second component part 112 when driving second component part 112 into the ground.

With reference to the FIGs., a method for driving a ground rod into the ground is provided. A method for driving a ground rod into the ground comprise axially aligning and coupling a male coupler, such as a portion of threaded dowel 32, of a longitudinally extending first component part 14 of a ground rod driving tool, 10 or 11, with a female coupler, such as threaded portion 30, of a longitudinally extending second component part 12 or 112 of the ground driving tool. First component part 14 of the ground rod driving tool has a sleeve 34 extending from a first longitudinal end configured to receive a portion of a ground rod 16, a ground rod stop 37, and the male coupler, such as a portion of threaded dowel 32, extending from a second longitudinal end. The second longitudinally extending second component part 12 of the ground rod driving tool has the female coupler, such as threaded portion 30, in a first longitudinal end thereof configured to closely receive an end portion of a ground rod 16.

The first ground rod end 26 is positioned on the ground 24. A portion of a second end 20 of ground rod 16 is received with sleeve 34. Sleeve portion 34 of the ground rod drive driving tool is repeatedly slid up and down, as shown with the double headed arrow in FIG. 1, about the second end 20 of ground rod 16 and impinging ground rod stop 37 and second ground rod end 20, thereby transferring the momentum of the ground rod driving tool to ground rod 16 and driving ground rod 16 into the ground until the sleeve 34 becomes proximate the ground 24. At this point, the ground rod driving tool is removed from ground rod 16 by lifting. The second component part 12 of the ground rod driving tool is then removed from the first component part 14. The second component part is then placed about the second ground rod end 20 of ground rod 16 and a portion of the second end of the ground rod 16 is closely received with the female coupler, such as threaded portion 30, of the second component part of the ground rod driving tool. A second longitudinal end of the second component part of the ground rod driving tool is then hammered and the ground rod is driven into the ground until the second end of the ground rod becomes proximate the ground. A portion of the second component part of the ground rod driving tool may be driven into the ground to provide a desired position of ground rod 16 with respect to the surface or grade of the ground 24.

In at least one aspect of the present disclosure, a ground rod driving tool is provided. The ground rod driving tool comprises a longitudinally extending sleeve 34 configured to closely receive an end portion of a ground rod, a stop 37 proximate an end of the longitudinally extending sleeve, and a male coupler 32 longitudinally extending from the end of the sleeve proximate the stop. A longitudinally extending ground rod cover 12 has a female coupler 30, in a longitudinal end thereof, configured to closely receive an end portion of a ground rod. The longitudinally extending sleeve 34 and the longitudinally extending ground rod cover 12 are coupled with their male and female couplers and have their longitudinal axes aligned. Female coupler 30 may be configured to closely receive an end portion of a ground rod. The male 32 and female 30 couplers are cooperatively threaded. The ground rod driving tool may have a mass sufficient to drive a ground rod into the ground by sliding the sleeve about the ground rod and impinging the ground rod stop. The ground rod cover, upon removal from the sleeve and closely receiving an end portion of a ground rod, may be configured to transfer a driving force from a hammer impinging a longitudinal end thereof, to a ground rod and drive the ground rod into the ground. The ground rod cover may be configured to resist fracture upon being hammered. The ground rod cover may comprise malleable hot rolled steel. The ground rod driving tool may have a center of gravity in a central third of its axial length. The longitudinal end of the ground rod cover having the female coupler may be chamfered. The ground rod driving tool may have a gripping feature on a portion of its outer surface.

NOMENCLATURE

Ground rod driving tool 10, 11
Second component part or ground rod cover 12, 112
First component part 14
Ground rod 16
Pin 18

First component part orifice 19
Second ground rod end 20
Knurling or gripping feature 22
Ground 24
First ground rod end 26
Threaded female coupler 30, 130
Non-threaded portion 31, 131
Threaded coupler or dowel 32
Dowel orifice 33
Sleeve 34
Chamfer 35, 135
Stop 37
Hammer 38
Portion of sleeve 39

The invention claimed is:

1. A ground rod driving tool comprising:

a longitudinally extending first component part comprising a sleeve configured to closely receive a portion of a ground rod, a ground rod stop, and a male coupler extending from a longitudinal end of the sleeve;

a longitudinally extending second component part having a female coupler in a first longitudinal end thereof configured to closely receive an end portion of a ground rod;

the first component part and the second component part being configured to couple and uncouple directly with each other, with the male and female couplers, and have their longitudinal axes aligned upon coupling;

the coupled first and second component parts having a mass sufficient to drive a ground rod into the ground by sliding the sleeve about the ground rod and impinging the ground rod stop;

the second component part being configured to transfer a driving force from a hammer impinging a second longitudinal end thereof, to a ground rod and drive the ground rod into the ground; and wherein the first longitudinal end of the second component part is chamfered.

2. A ground rod driving tool comprising:

a longitudinally extending sleeve configured to closely receive an end portion of a ground rod;

a stop proximate an end of the longitudinally extending sleeve;

a male coupler longitudinally extending from the end of the sleeve proximate the stop;

a longitudinally extending ground rod cover having a female coupler, in a longitudinal end thereof;

the longitudinally extending sleeve and the longitudinally extending ground rod cover being coupled with their male and female couplers and having their longitudinal axes aligned;

the longitudinally extending sleeve and the longitudinally extending ground rod cover being configured to be uncoupled with their male and female couplers; and wherein the ground rod cover, upon removal from the sleeve and closely receiving an end portion of a ground rod, is configured to transfer a driving force from a hammer impinging a longitudinal end thereof, to a ground rod and drive the ground rod into the ground.

3. The ground rod driving tool of claim 2 wherein the male and female couplers are cooperatively threaded together.

4. The ground rod driving tool of claim 2 having a mass sufficient to drive a ground rod into the ground by sliding the sleeve about the ground rod and impinging the ground rod stop.

5. The ground rod driving tool of claim 2 wherein the ground rod cover is configured to resist fracture upon being hammered.

6. The ground rod driving tool of claim 5 wherein the ground rod cover comprises malleable hot rolled steel.

7. The ground rod driving tool of claim 2 having a center of gravity in a central third of its length.

8. The ground rod driving tool of claim 2 wherein the longitudinal end of the ground rod cover having the female coupler is chamfered.

9. The ground rod driving tool of claim 2 wherein at least a portion of an outer surface of the ground rod driving tool has a gripping feature.

10. The ground rod driving tool of claim 2 wherein the female coupler is configured to contact a ground rod and resist separation from the ground rod upon its other longitudinal end being impinged with a hammer.

11. A ground rod driving tool comprising:

a longitudinally extending sleeve configured to receive an end portion of a ground rod;

a stop proximate an end of the longitudinally extending sleeve;

a male coupler longitudinally extending from the end of the sleeve proximate the stop;

a longitudinally extending ground rod cover having a female coupler, in a longitudinal end thereof;

the longitudinally extending sleeve and the longitudinally extending ground rod cover being coupled with their male and female couplers and having their longitudinal axes aligned;

the longitudinally extending sleeve and the longitudinally extending ground rod cover being configured to be uncoupled with their male and female couplers; and wherein the ground rod driving tool has a center of gravity in a central third of its length.

12. The ground rod driving tool of claim 11 wherein the ground rod cover is configured to resist fracture upon being hammered.

13. The ground rod driving tool of claim 12 wherein the ground rod cover comprises malleable hot rolled steel.

14. The ground rod driving tool of claim 11 wherein the longitudinal end of the ground rod cover having the female coupler is chamfered.

15. The ground rod driving tool of claim 11 wherein at least a portion of an outer surface has a gripping feature.

16. The ground rod driving tool of claim 11 wherein the female coupler is configured to contact a ground rod and resist separation from the ground rod upon its other longitudinal end being impinged with a hammer.

17. The ground rod driving tool of claim 11 wherein the female coupler is configured to closely receive an end portion of a ground rod.

18. The ground rod driving tool of claim 11 wherein the male and female couplers are threaded couplers and are cooperatively threaded together.

19. The ground rod driving tool of claim 11 having a mass sufficient to drive a ground rod into the ground by sliding the sleeve about the ground rod and impinging the ground rod stop.

20. The ground rod driving tool of claim 11 wherein the ground rod cover, upon removal from the sleeve and receiving an end portion of a ground rod, is configured to transfer a driving force from a hammer impinging a longitudinal end thereof, to a ground rod and drive the ground rod into the ground.

* * * * *